US007489090B2

(12) United States Patent
Taipale

(10) Patent No.: US 7,489,090 B2
(45) Date of Patent: Feb. 10, 2009

(54) ELECTRONIC BALLAST HAVING ADAPTIVE FREQUENCY SHIFTING

(75) Inventor: Mark S. Taipale, Harleysville, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 544 days.

(21) Appl. No.: 11/352,962

(22) Filed: Feb. 13, 2006

(65) Prior Publication Data

US 2007/0188111 A1 Aug. 16, 2007

(51) Int. Cl.
*G05F 1/00* (2006.01)

(52) U.S. Cl. ..... 315/307; 315/291; 315/308

(58) Field of Classification Search ..... 315/209 R, 315/224, 247, 291, 297, 307, 308
See application file for complete search history.

(56) References Cited

U.S. PATENT DOCUMENTS

| | | | | |
|---|---|---|---|---|
| 6,452,344 | B1 | 9/2002 | MacAdam et al. | |
| 6,642,669 | B1 | 11/2003 | MacAdam et al. | |
| 6,674,248 | B2 * | 1/2004 | Newman et al. | 315/247 |
| 6,982,528 | B2 * | 1/2006 | Cottongin et al. | 315/309 |
| 7,061,189 | B2 * | 6/2006 | Newman et al. | 315/291 |
| 2003/0052623 | A1 | 3/2003 | Muehlschlegel | |
| 2005/0179404 | A1 | 8/2005 | Veskovic et al. | |

FOREIGN PATENT DOCUMENTS

WO 01/69983 A1 9/2001

OTHER PUBLICATIONS

European Patent Office, International Search Report and Written Opinion, Jun. 14, 2007, 11 pages.

* cited by examiner

*Primary Examiner*—Douglas W. Owens
*Assistant Examiner*—Jimmy T Vu
(74) *Attorney, Agent, or Firm*—Mark E. Rose; Philip N. Smith

(57) ABSTRACT

An electronic ballast for driving a gas discharge lamp avoids mercury pumping in the lamp by adaptively changing an operating frequency of an inverter of the ballast when operating near high-end. The inverter of the ballast generates a high-frequency AC voltage, which is characterized by the operating frequency and an operating duty cycle. The ballast also comprises a resonant tank for coupling the high-frequency AC voltage to the lamp to generate a present lamp current through the lamp, and a current sense circuit for determining the magnitude of the present lamp current. A hybrid analog/digital control circuit controls both the operating frequency and the operating duty cycle of the inverter with closed-loop techniques. The control circuit adjusts the duty cycle of the inverter in response to a target lamp current and the present lamp current. To avoid mercury pumping, the control circuit attempts to maximize the duty cycle of the inverter when operating at high-end. Specifically, the control circuit adjusts the operating frequency of the inverter in response to the target lamp current signal, the duty cycle of the inverter, and a target duty cycle in order to drive the operating duty cycle toward the target duty cycle.

41 Claims, 14 Drawing Sheets

ELECTRONIC BALLAST HAVING ADAPTIVE FREQUENCY SHIFTING

FIELD OF THE INVENTION

The present invention relates to electronic ballasts and, more particularly, to electronic dimming ballasts for gas discharge lamps, such as fluorescent lamps.

BACKGROUND OF THE INVENTION

Electronic ballasts for fluorescent lamps typically can be analyzed as comprising a "front-end" and a "back-end". The front-end typically includes a rectifier for changing alternating-current (AC) mains line voltage to a direct-current (DC) bus voltage, and a filter circuit, e.g., a capacitor, for filtering the DC bus voltage. The front-end of electronic ballasts also often includes a boost converter, which is an active circuit for boosting the magnitude of the DC bus voltage above the peak of the line voltage and for improving the total harmonic distortion (THD) and the power factor of the input current to the ballast. The ballast back-end typically includes a switching inverter for converting the DC bus voltage to a high-frequency AC voltage, and a resonant tank circuit having a relatively high output impedance for coupling the high-frequency AC voltage to the lamp electrodes.

Referring first to FIG. 1, there is shown a simplified block diagram of a prior art electronic ballast 100. The ballast 100 includes a front-end 102 for producing a substantially DC bus voltage across a bus capacitor, $C_{BUS}$, from an AC input voltage. The ballast 100 further comprises an inverter 104 for converting the DC bus voltage into a high-frequency voltage for driving a lamp current in a fluorescent lamp 108. The high-frequency voltage provided by the inverter 104 is coupled to the lamp 108 through a resonant tank 106 having a resonant inductor, $L_{RES}$, and a resonant capacitor, $C_{RES}$.

The inverter 104 includes first and second series-connected switching devices 112, 114 and a gate drive circuit 116. The switching devices 112, 114 in the inverter 104 are controlled using a d(1−d) complementary switching scheme. In the d(1−d) complementary switching scheme, the first switching device 112 has a duty cycle of d and the second switching device 114 has a duty cycle of 1−d. The switching devices 112, 114 are controlled by the gate drive circuit 116 such that only one switching device is conducting at a time. When the first switching device 112 is conducting, then the output of the inverter 104 is pulled upwardly toward the DC bus voltage. When the second switching device 114 is conducting, then the output of the inverter 104 is pulled downwardly toward circuit common.

The current through the lamp 108 is controlled by changing the frequency and/or the duty cycle of the high-frequency voltage at the output of the inverter 104. A current sense circuit 110 is coupled in series with the lamp 108 and provides a lamp current signal 250 representative of the magnitude of the current through the lamp. An analog control circuit 210 is responsible for controlling the gate drive circuit 116 and thus the switching devices 112, 114 of the inverter 104. The analog control circuit 210 includes a reference circuit 212, a summing circuit 214, a compensator circuit 216, a frequency-shift circuit 218, a triangle-wave oscillator 222, and a comparator 220. The reference circuit 212 provides a reference signal 242 representative of a target current $I_{TARGET}$ for the lamp 108. The summing circuit 214 receives the lamp current signal 250 and the reference signal 242 and creates an error signal 240 representative of the difference between the target current and the actual current in the lamp 108. The compensator circuit 216 receives the error signal 240 and provides a duty cycle request voltage 246 that is proportional to the desired duty cycle of the inverter 104.

The frequency shift circuit 218 also receives the reference signal 242 and provides a desired frequency signal 245 representative of the desired inverter frequency. The triangle-wave oscillator 222 receives the desired frequency signal 245 from the frequency shift circuit 218 and provides a triangle-wave signal 244 at the desired frequency. The comparator 220 receives both the triangle wave signal 244 and the duty cycle request voltage 246 and produces a pulse width modulated (PWM) signal 248 with the desired frequency and duty cycle. This PWM signal 248 is provided to the gate drive circuit 116, which drives the switches 112, 114 in the inverter 104.

In addition to the normal running mode, the ballast 100 has several other modes of operation including a "preheat" mode and a "strike" mode. The purpose of the preheat mode is to heat the lamp filaments prior to the application of a sufficient voltage to strike the lamp. During the strike mode, the lamp voltage is increased until either the lamp strikes or a predetermined voltage limit is reached.

Preheat is accomplished by controlling the frequency of the inverter 104 to a preheat frequency, which is greater than the frequency of the inverter 104 in normal operation. During preheat, the compensator circuit 216 is always in control of the duty cycle of the inverter 104. At the same time, the reference circuit 212 provides a reference signal 242 at a level that represents a non-zero lamp current. Since there is no current through the lamp during preheat, the current sense circuit 110 produces the lamp current signal 250 with a positive magnitude and thus the output of the summing circuit 214, i.e., the error signal 240, has a non-zero value. The compensator circuit 216 includes an integrator (not shown), so the non-zero error signal 240 causes the compensator circuit 216 to increase the duty cycle of the duty cycle request voltage 246 to 50%, at which time the compensator circuit saturates. At this point, the duty cycle of the duty cycle request voltage 246 is fixed at 50% and the preheat voltage is adjusted by changing the frequency. It is important to note that since the compensator circuit 216 contains an integrator, it is not possible to set the duty cycle to an arbitrary level. In practice, the choices would be saturated at 50% or saturated at 0%. An alternative would be to provide additional circuitry to clamp the output of the compensator circuit 216 at a given level during preheat, but this would add additional cost and complexity.

To strike the lamp 108, i.e., in the strike mode, the operating frequency of the inverter 104 is swept down from the preheat frequency to a low-end frequency. Preferably, the low-end frequency is near the resonant frequency $\omega_R$ of the resonant tank 106, i.e., $\omega_R = 1/\sqrt{(L_{RES} * C_{RES})}$. Accordingly, the voltage at the output of the resonant tank 106 at the low-end frequency is substantially large and is appropriate to strike the lamp 108. When the lamp 108 strikes, the lamp current begins to flow through the lamp. At this time, the compensator circuit 216 of the analog control circuit 210 is still saturated and the duty cycle of the duty cycle request voltage 246 is still 50%. As a result, a current above the target current starts to flow through the lamp 108. This excess current will cause the compensator circuit 216 to come out of saturation and to set the duty cycle of the PWM signal 248 so as to maintain the target current in the lamp 108. While the compensator circuit 216 is saturated, the current in the lamp 108 can be significantly higher than the target current. The high current, along with the time required for the loop to come out of saturation, can result in a noticeable flash when the lamps strike.

A simplified schematic diagram of another prior art electronic ballast 300 is shown in FIG. 2. The ballast 200 operates in a similar manner as the ballast 100 shown in FIG. 1, but the analog control circuit 210 has been replaced by a digital control circuit 310. An analog-to-digital converter (ADC) 352 in a microprocessor 350 receives the lamp current signal 250 from the current sense circuit 110 and converts it into an 8-bit digital representation. The reference signal 242 representative of the target current in the lamp 108 is received at an input 355. The software in the microprocessor 350 then compares the measured current with the target current to generate an error signal, which is then used to generate a desired duty cycle. The desired frequency is determined from the desired current. A pulse-width modulated (PWM) signal 356 is produced at an output 354 of the microprocessor 350. The software in the microprocessor 350 drives the PWM signal 356 with the desired frequency and duty cycle and provides the PWM signal to the gate drive circuit 116. In the ballast 300, software in the microprocessor 350 of the digital control circuit 310 provides the functionality that was provided by the analog control circuit 210 of the ballast 100.

The digital implementation of the preheat mode of the ballast 300 is very different than the preheat mode of the ballast 100. The software that normally implements the compensator routine is not in control of the inverter duty cycle. In fact, a completely different routine is in control of the inverter. As a result, it is possible to directly control both the duty cycle and the frequency to achieve the desired preheat level.

In the digital implementation of the strike mode, the duty cycle is held at a fixed level and the frequency is swept down from the preheat frequency to the low-end frequency. During this period, the software must monitor the lamp voltage and lamp current to detect when the lamp strikes. It is very important to detect when the lamp strikes because once it is struck, a different routine must be run to implement the normal operation control loop. Since both the frequency and duty cycle are controllable during strike, it would be possible to set the duty cycle to something less than 50% during the strike phase. The lower duty cycle would result in the lamp starting at a lower current to help reduce flash. However, in order to ensure accurate detection of lamp strike, the lamp must strike with a relatively high current.

Replacing the analog control circuit 210 of the ballast 100 with the digital control circuit 310 of the ballast 300 has several benefits. First, there are fewer parts in the digital control circuit 310 since most of the control functions are completed by the microprocessor 350. Second, the control functions provided by the microprocessor 350 can be easily altered without the need to change any hardware of the digital control circuit 310. Further, situation-specific software can be executed when the ballast 300 is in different normal and abnormal modes of operation.

However, the digital control circuit 310 has some disadvantages in view of the analog control circuit 210. The capability of the microprocessor 350 is dependent on the cost of the device. So, in order to achieve a reasonable cost, some compromises may need to be made in the areas of core speed, ADC resolution, ADC sampling rate and math capability. Quantization effects of the ADC conversion can become significant at low dim levels. This can be improved with a higher resolution ADC or a higher sampling rate, but as mentioned earlier, higher capability results in higher cost for the microprocessor 350.

Both the analog control circuit 210 and the digital control circuit 310 of the prior art ballast 100, 300 use an open-loop frequency shift in which there is a predetermined operating frequency for a given desired light level. The concept of adjusting both the frequency and the duty cycle of the inverter 104 is described in greater detail in U.S. Pat. No. 6,452,344, issued Sep. 17, 2002, entitled "Electronic Dimming Ballast", which is hereby incorporated herein by reference in its entirety.

FIG. 3 is a simple control system diagram illustrating the control loops of the prior art ballasts 100, 300. The operating duty cycle, $d_{OP}$, of the inverter is controlled through a closed-loop technique, while the operating frequency, $f_{OP}$, is controlled through an open-loop technique. The actual lamp current, $I_{ACTUAL}$, is provided as feedback to the duty-cycle control loop and is subtracted from the target current, $I_{TARGET}$, to produce a lamp current error signal, $e_I$, and ultimately, the desired operating duty cycle $d_{OP}$. In contrast, the desired operating frequency $f_{OP}$ is simply generated solely in response to the target current $I_{TARGET}$.

FIG. 4 shows a plot of the target operating frequency of the inverter 104 versus the lamp current and a plot of the operating frequency versus the lamp current at a fixed 50% duty cycle, which demonstrates the maximum current that can be delivered by the ballast 100, 300 at a given frequency. At low light levels, the ballast operating frequency is maintained at the low-end frequency $f_{LOW\text{-}END}$, which is near the resonant frequency of the resonant tank 106. Above a predetermined level, the operating frequency is decreased linearly as the lamp current increases, i.e., as the desired lighting level of the lamp 108 increases towards high-end.

One complication that results from operating the inverter 104 at a frequency that is away from the resonant frequency when utilizing the d(1−d) switching scheme (i.e., at high-end) is the possibility of "mercury pumping". As the operating frequency moves away from the resonant frequency, and the impedance of the lamp 108 decreases (as the lamp current increases), the filtering effect of the resonant tank 106 is reduced. When the inverter 104 is operating at any duty cycle other than 50%, the voltage at the output of the inverter is asymmetric and contains second harmonic content. For duty cycles near 50%, the second harmonic is not significant. However, as the duty cycle moves away from 50%, the second harmonic content increases.

When operating at the high-end frequency $f_{HIGH\text{-}END}$, a significant amount of this second harmonic content from the inverter 104 is passed through the resonant tank 106 to the lamp 108. As a result, the lamp current is not symmetric. Blocking capacitors, e.g., capacitor 118 in FIGS. 1 and 2, at the output of the ballast 100, 300 prevent the ballast from delivering significant DC current to the lamp 108. However, the asymmetric current in the lamp 108 coupled with the non-linear lamp load results in a DC voltage on the lamp 108. The DC voltage on the lamp 108 will cause mercury ions to migrate from one end of the lamp to the other. If the DC voltage is high enough, the lamp 108 will become starved for mercury at one end. As a result, the starved end of the lamp 108 will produce less light and may also turn pink.

In order to avoid significant mercury pumping, the analog control circuit 210 and the digital control circuit 310 of the prior art ballasts 100, 300 utilized frequency shift profiles that were selected to insure that the duty cycle was as close to 50% as possible when operating at the high-end frequency. However, the tolerances of the components of the resonant tank 106, and the variations in the operating characteristics of common fluorescent lamps, require that the frequency be selected such that even worst-case combinations are capable of reaching the needed high-end current $I_{HIGH\text{-}END}$. The constraints of being able to reach high-end in the worst case while having the highest duty cycle possible result in the need for tight tolerances on components and the need to tailor tank component values to a narrow load range.

Thus, there exists a need for an electronic ballast that avoids mercury pumping and operates at high-end with a duty cycle close to 50% and has a broad range of load types, but does not require a resonant tank that has components with small tolerances.

SUMMARY OF THE INVENTION

According to the present invention, an electronic ballast for driving a gas discharge lamp includes an inverter, a resonant tank, a control circuit, and a current sense circuit. The inverter converts a substantially DC bus voltage to a high-frequency AC voltage having an operating frequency and an operating duty cycle. The resonant tank couples the high-frequency AC voltage to the lamp to generate a present lamp current through the lamp. The control circuit is operable to control the operating frequency and the operating duty cycle of the high-frequency AC voltage of the inverter. The current sense circuit provides to the control circuit a present lamp current signal representative of the present lamp current. The control circuit is operable to control the operating duty cycle of the high-frequency AC voltage of the inverter in response to a target lamp current signal and the present lamp current signal. Further, the control circuit is operable to control the operating frequency of the high-frequency AC voltage of the inverter in response to the operating duty cycle and a target duty cycle, such that the control circuit is operable to minimize the difference between the operating duty cycle and the target duty cycle. Preferably, the control circuit is further operable to control the operating frequency to a base operating frequency in dependence on the target lamp current signal, when the target lamp current changes in value.

The present invention further provides a method for controlling an electronic ballast for driving a gas discharge lamp. The ballast comprises an inverter characterized by an operating frequency and an operating duty cycle. The method comprises the steps of generating a present lamp current through the gas discharge lamp in response to the operating frequency and the operating duty cycle of the inverter; generating a present lamp current signal representative of the present lamp current; receiving a target lamp current signal representative of a target lamp current; controlling the duty cycle of the inverter in response to the target lamp current signal and the present lamp current signal; and controlling the operating frequency of the inverter in response to the target lamp current signal, the operating duty cycle of the inverter, and a target duty cycle, such that the difference between the operating duty cycle and the target duty cycle is minimized.

In addition, the present invention provides a control circuit for an electronic ballast having an inverter for driving a gas discharge lamp. The control circuit is operable to control an operating frequency and an operating duty cycle of the inverter of the ballast. The control circuit comprises a duty cycle control portion for controlling the operating duty cycle of the inverter in response to a target lamp current signal and a present lamp current signal, and a frequency control portion for controlling the operating frequency of the inverter in response to the target lamp current signal, the operating duty cycle, and a target duty cycle. The difference between the operating duty cycle and the target duty cycle is minimized.

DETAILED DESCRIPTION OF THE INVENTION

Figure 1:
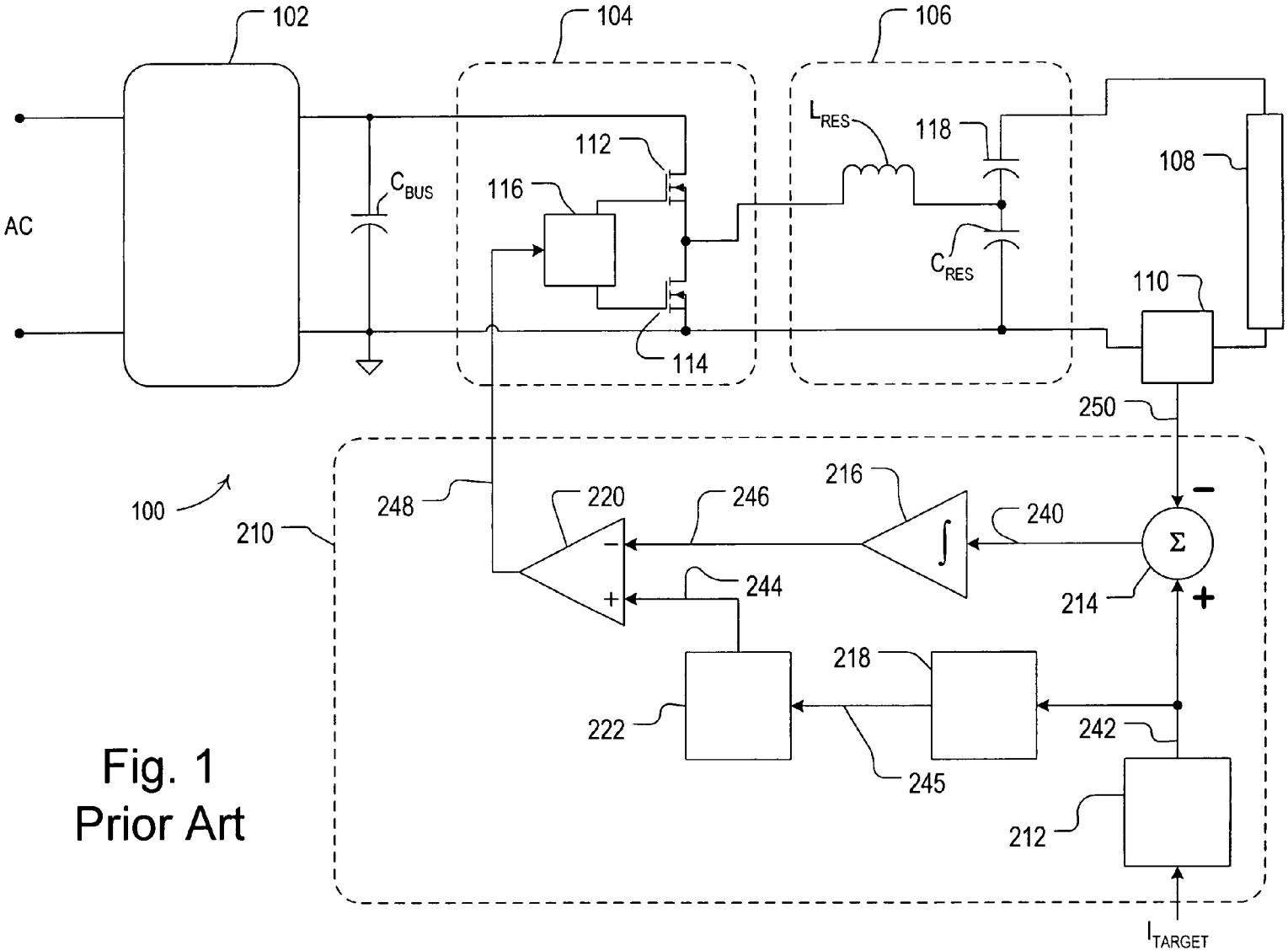
Fig. 1 Prior Art
FIG. 1 is a simplified schematic diagram of a prior art electronic ballast having an analog control circuit.
Figure 2:
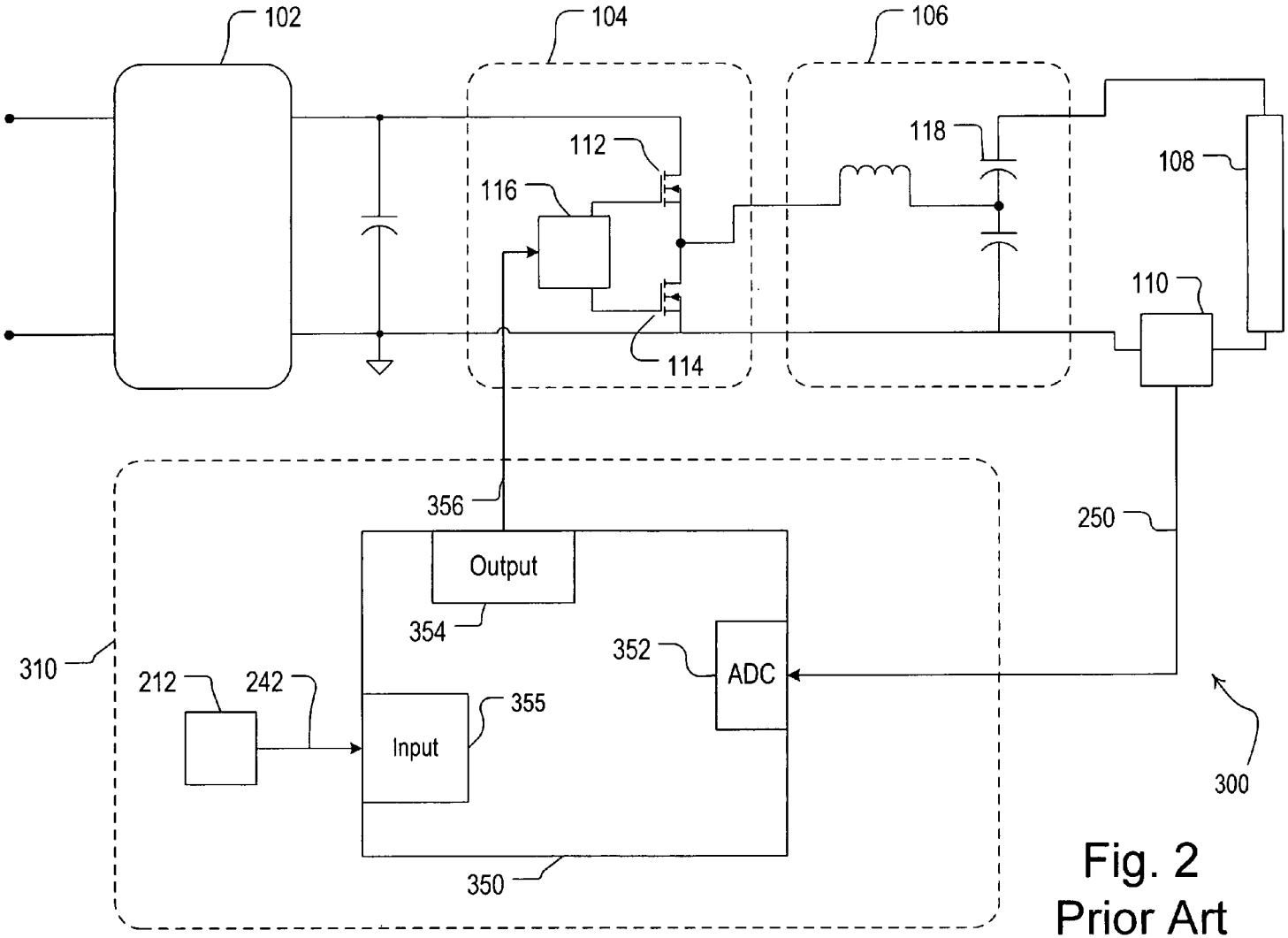
Fig. 2 Prior Art
FIG. 2 is a simplified schematic diagram of a prior art electronic ballast having a digital control circuit.
Figure 3:
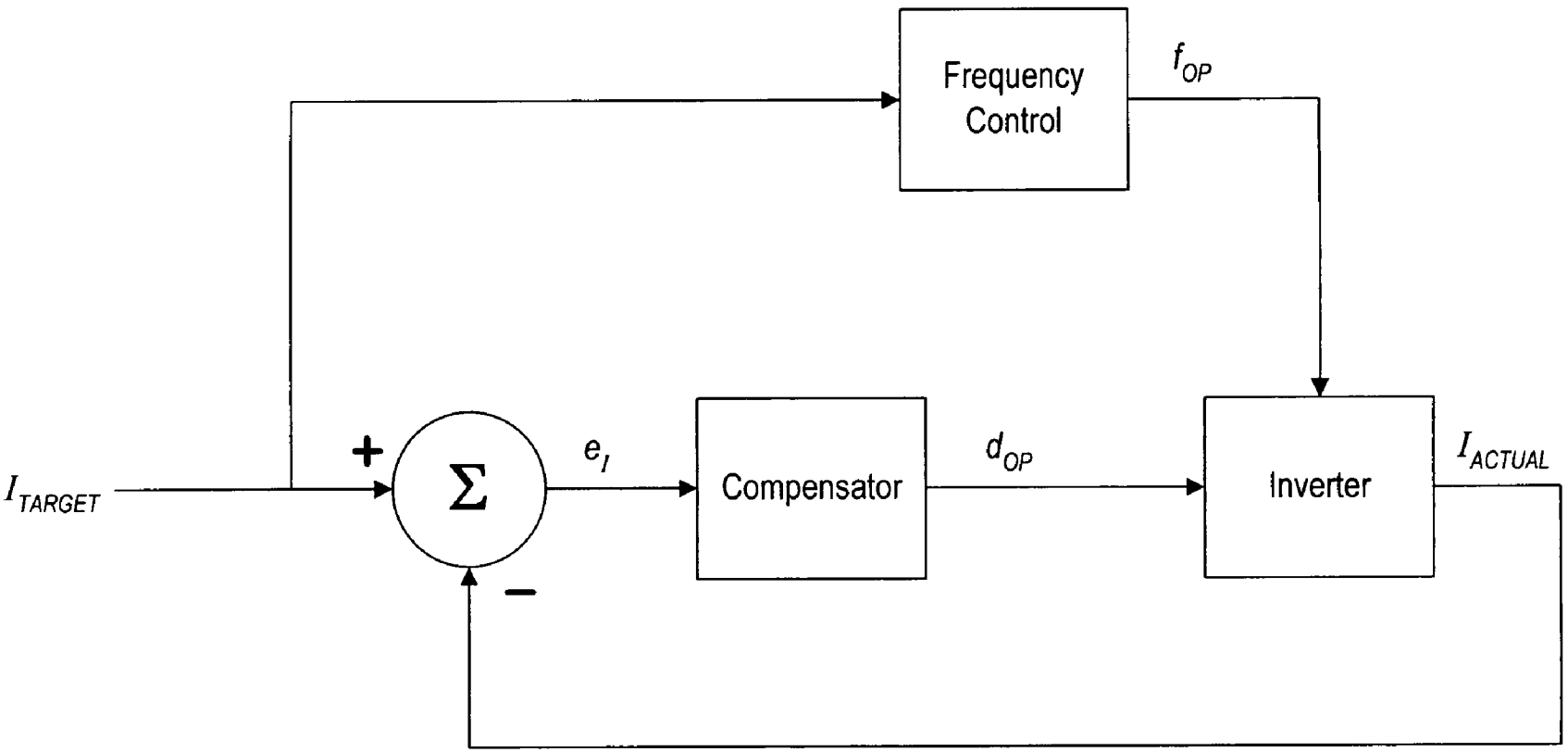
Fig. 3 Prior Art
FIG. 3 is a simplified control system diagram illustrating the control loops of the prior art ballasts of FIGS. 1 and 2.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 5A:
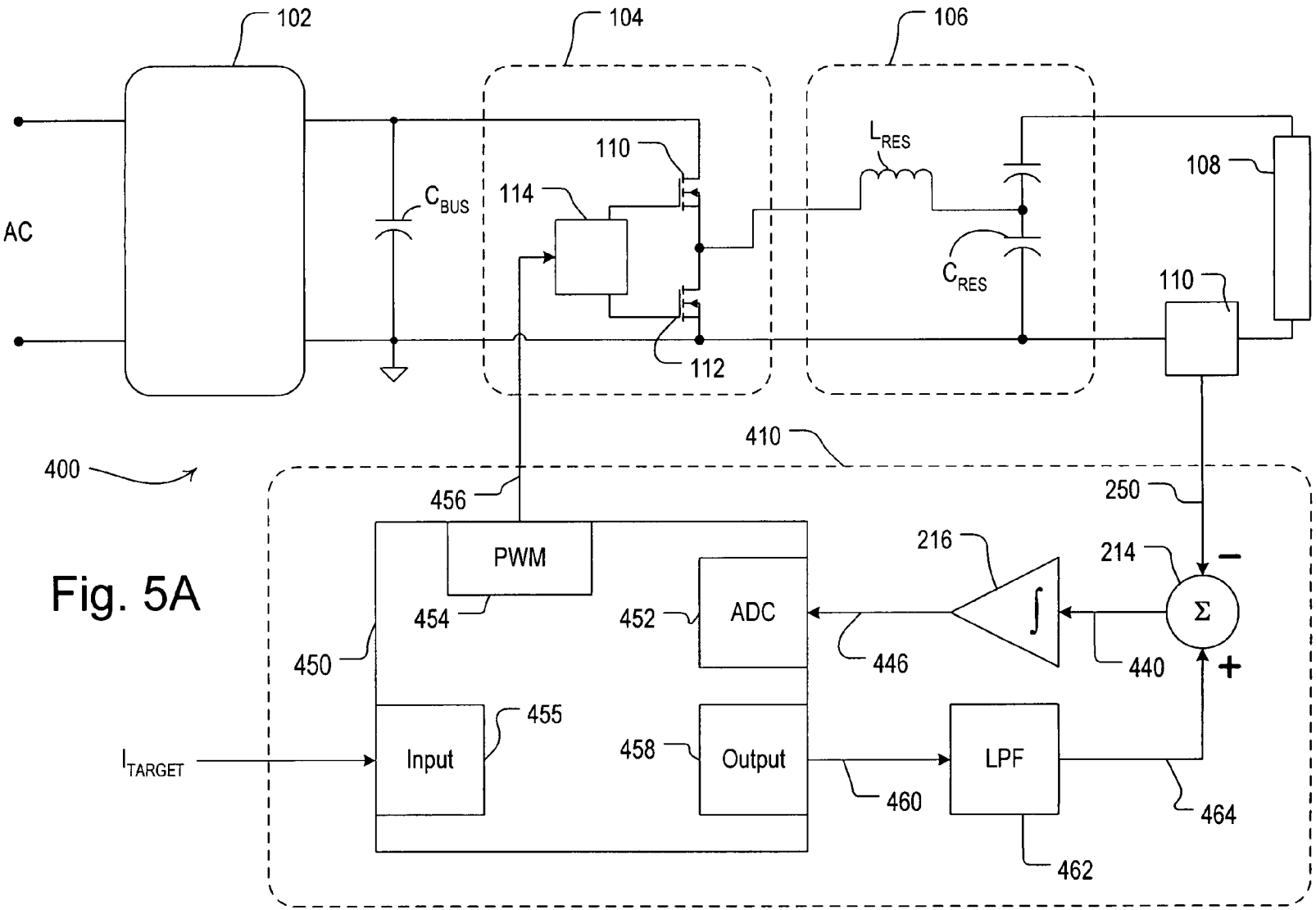
FIG. 5A is a simplified schematic diagram of an electronic ballast according to the present invention.

FIG. 5A shows a simplified block diagram of an electronic ballast 400 according to the present invention. The ballast 400 includes many similar blocks as the prior art ballasts 100, 300, which each have the same function as described previously. However, those components of the ballast 300 that differ from the prior art ballast 100 will be described in greater detail below.

The ballast 400 includes a hybrid analog/digital control circuit 410. The hybrid control circuit 410 improves on the characteristics of the analog control circuit 210 and digital control circuit 310 of the prior art ballasts 100, 300. The hybrid control circuit 410 includes the summing circuit 214 and the compensator circuit 216, which function the same as those circuits in the prior art ballast 100.

The hybrid control circuit 410 further comprises a microprocessor 450, which provides a PWM signal 456 at an operating frequency, $f_{OP}$, and an operating duty cycle, $d_{OP}$, to the gate drive circuit 116 of the inverter 104. The microprocessor 450 receives a target lamp current, $I_{TARGET}$, via an input 455. The target lamp current $I_{TARGET}$ may be obtained, for example, from a phase-control input (not shown) or from a digital message received from a communication link (not shown). A ballast operable to receive a phase-control input is described in greater detail in the previously mentioned U.S. Pat. No. 6,452,344. A ballast operable to be coupled to a digital communication link is described in greater detail in co-pending U.S. patent application Ser. No. 10/824,248, Publication No. 2005/0179404, filed Apr. 14, 2004, entitled "Multiple-Input Electronic Ballast with Processor", which is hereby incorporated herein by reference in its entirety.

The microprocessor 450 provides a PWM reference signal 460, having a duty cycle dependent on the target lamp current $I_{TARGET}$, at an output port 458. A low pass filter 462 generates a DC reference signal 464, which is representative of a desired current in the lamp 108, from the PWM reference signal 460. The summing circuit 214 receives the present lamp current signal 250 and the DC reference signal 464 and creates a lamp current error signal 440 representative of the difference between the target current and the actual current in the lamp. The compensator circuit 216 receives the error signal 440 and provides a duty cycle request signal 446, which is a DC voltage inversely proportional to the desired duty cycle of the inverter 104.

Figure 5B:
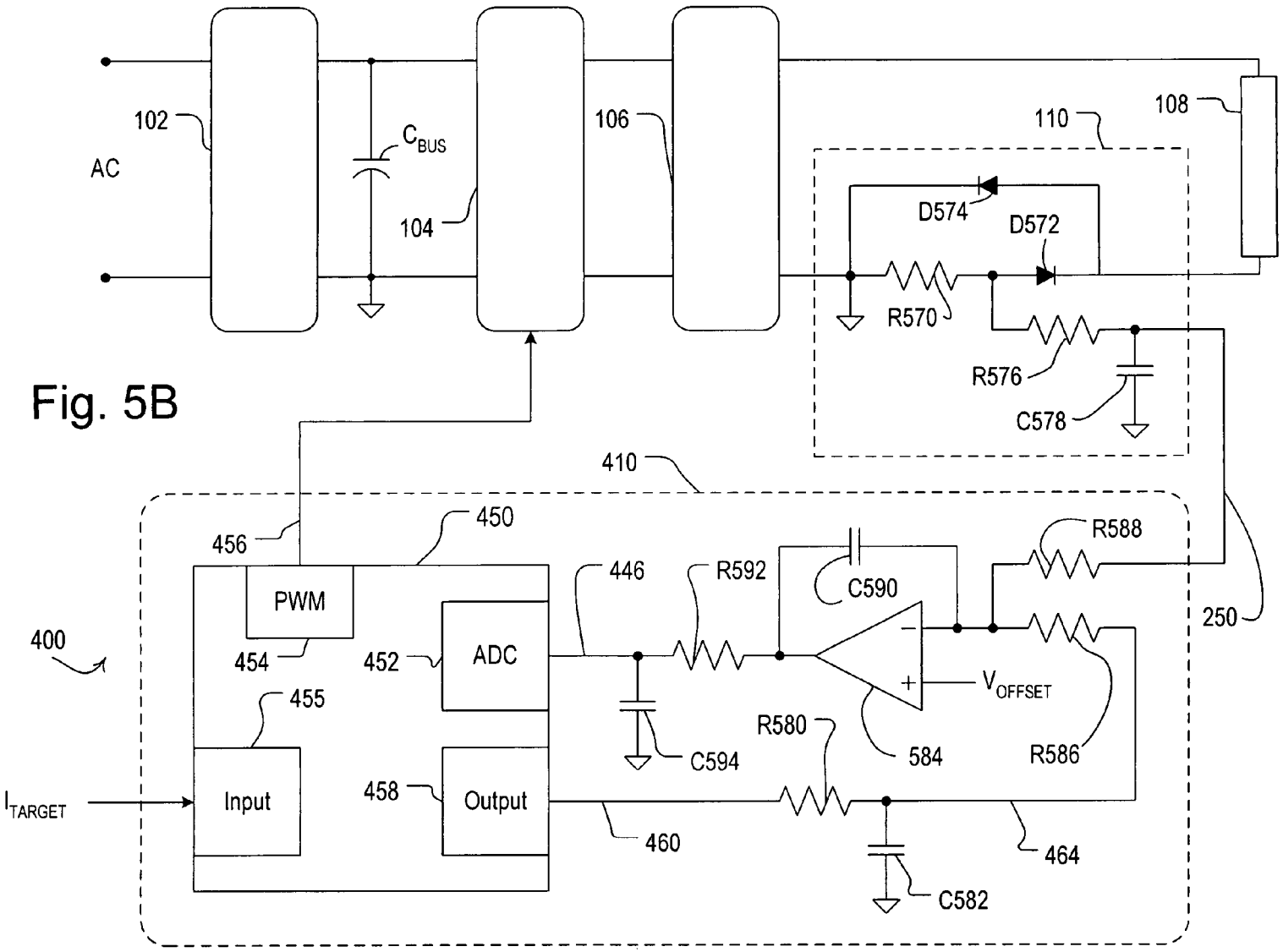
FIG. 5B is a simplified schematic diagram of the electronic ballast of FIG. 5A.

FIG. 5B is a simplified schematic diagram of the electronic ballast 400 showing the current sense circuit 110 and the hybrid control circuit 410 in greater detail. During the negative portions of the AC current through the lamp 108, the lamp current flows through a resistor R570 and a diode D572. Alternatively, the lamp current flows through only a diode D574 to circuit common during the positive portions of the lamp current. A resistor R576 and a capacitor C578 filter the voltage produced across the resistor R570 and generate the lamp current signal 250. Accordingly, the lamp current signal 250 provides a substantially DC voltage having a negative magnitude representative of the current through the lamp 108.

The PWM reference signal 460 provided at the output port 458 of the microprocessor 450 is filtered by the low pass filter 462 comprising a resistor R580 and a capacitor C582 to produce the DC reference signal 464 representative of the target lamp current $I_{TARGET}$. The DC reference signal 464 and the lamp current signal 250 are provided to the inverting input of an operational amplifier (op amp) 584 through resistors R586 and R588, respectively. A DC offset voltage $V_{OFFSET}$ is provided to the non-inverting input of the op amp 584. A capacitor C590 is connected between the inverting input and the output of the op amp 584 to provide the integration functionality of the compensator circuit 216. Accordingly, the output of the op amp 584 is a function of the integral of the sum of the DC reference signal 464 and the lamp current signal 250. Finally, the voltage at the output of the op amp 584 is filtered by a resistor R592 and a capacitor C594 to provide the duty cycle request signal 446 to the microprocessor 450.

Figure 6A:
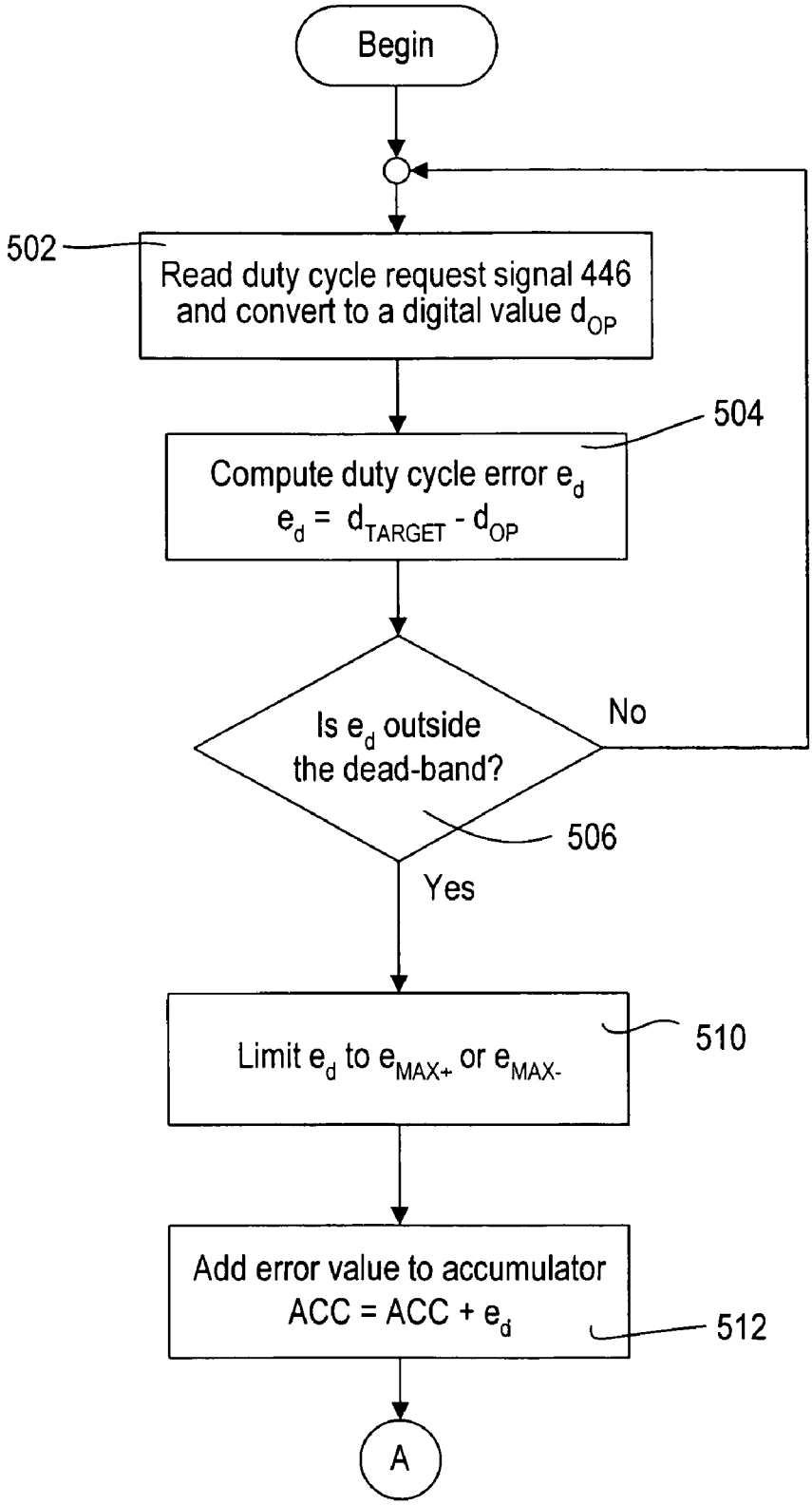
FIGS. 6A and 6B are flowcharts of the software executed by a microprocessor of the ballast of FIG. 5A according to the present invention.
Figure 6B:
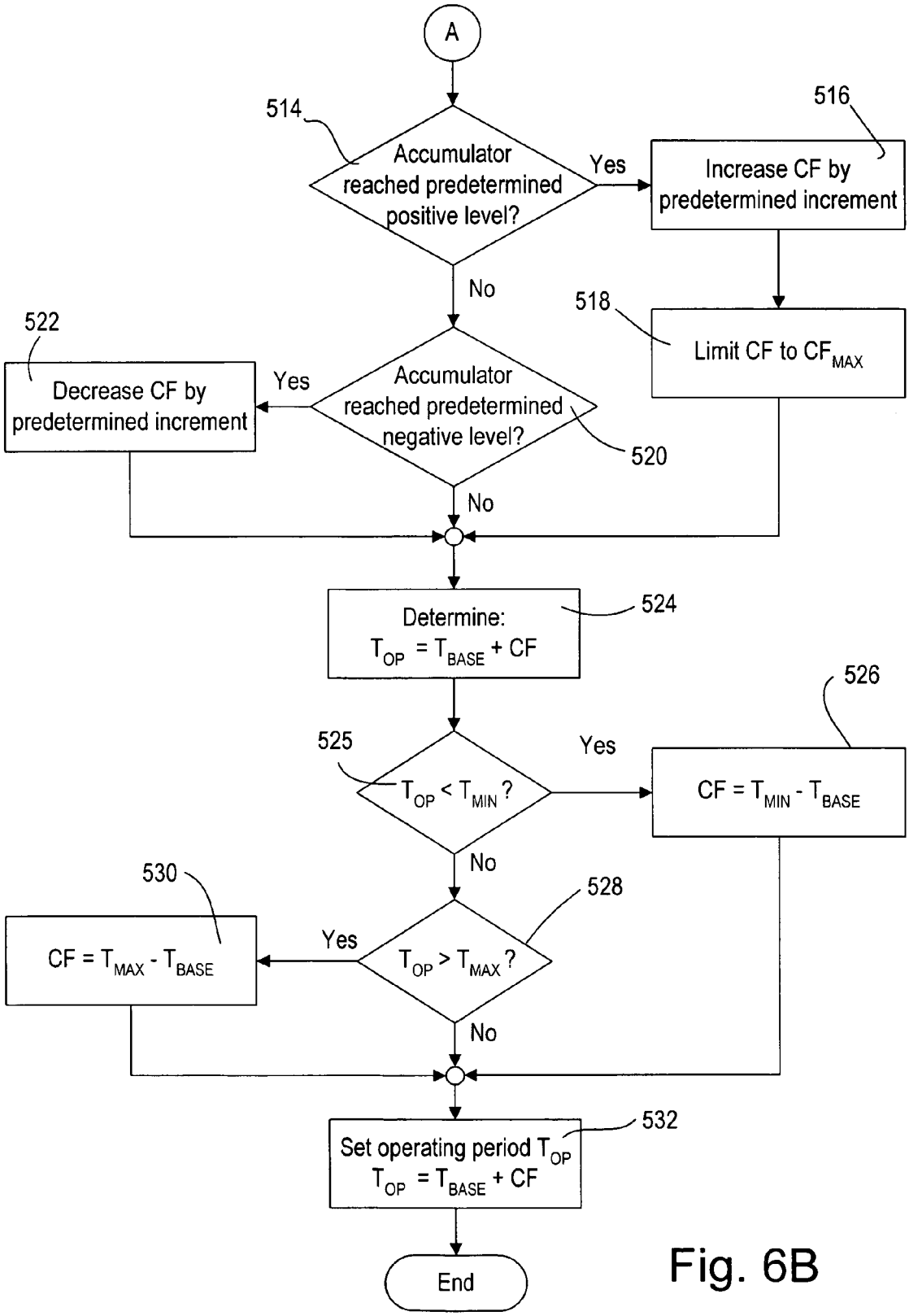

FIGS. 6A and 6B are flowcharts of the software executed cyclically by the microprocessor 450 of the ballast 400 in order to adaptively change the operating frequency $f_{OP}$ of the inverter 104 according to the present invention. The flowcharts of FIGS. 6A and 6B will be described with reference to the schematic diagram of the ballast 400 of FIG. 5A. Preferably, the process of FIGS. 6A and 6B repeats every 104 μsec.

An ADC 452 in the microprocessor 450 receives the duty cycle request signal 446 and converts the signal into a digital value (at step 502). Since the duty cycle request signal 446 is inversely proportional to the operating duty cycle $d_{OP}$, the microprocessor 450 inverts and scales the digital value to generate the operating duty cycle $d_{OP}$. For example, the operating duty cycle $d_{OP}$ is linearly scaled such that a digital value of 0 corresponds to an operating duty cycle of 0% and a digital value of 512 corresponds to an operating duty cycle of 100%. In normal operation, the software in the microprocessor 450 uses the operating duty cycle $d_{OP}$ along with the operating frequency $f_{OP}$ to calculate an operating period, $T_{OP}$, and an on-time, $t_{ON}$. The operating frequency $f_{OP}$ is determined from the target lamp current $I_{TARGET}$ and the operating duty cycle $d_{OP}$, as will be described in greater detail below. The operating period $T_{OP}$ and the on-time $t_{ON}$ are used by a PWM module 454 to provide the PWM signal 456 at the operating frequency $f_{OP}$ and the operating duty cycle $d_{OP}$. The microprocessor 450 is operable to set the operating duty cycle $d_{OP}$ as either the duty cycle provided by the duty cycle request signal 446 or some other duty cycle.

While in normal operation, the microprocessor 450 monitors the present operating duty cycle $d_{OP}$ of the inverter 104. The operating duty cycle $d_{OP}$ is subtracted from a predetermined target duty cycle, $d_{TARGET}$, e.g., preferably 43%, to obtain a duty cycle error value, $e_d$ (at step 504). If the error value $e_d$ is inside of a dead-band (at step 506), the process loops around to read the duty cycle request signal 446 again. The dead-band is a range through which the error value $e_d$ can be varied without initiating a response in order to prevent oscillations. The dead-band is preferably 1% above and below the predetermined target duty cycle $d_{TARGET}$, e.g., 42% to 44%. If the duty cycle error value $e_d$ is outside of the dead-band, the error value is then limited to a maximum positive error value, $e_{MAX+}$, e.g., 2%, or a maximum negative error value, $e_{MAX-}$, e.g., −2%, (at step 510) in dependence on the sign of the error value. For example, if the error value $e_d$ is −2.5%, the error value $e_d$ will be limited to −2%.

Next, the error value $e_d$ is added to a 16-bit accumulator ACC in the microprocessor 450, thereby increasing (or decreasing) the value of the accumulator (at step 512). When the accumulator reaches a predetermined positive value (or a predetermined negative value), the microprocessor 450 will reset the accumulator and change the operating frequency $f_{OP}$ of the ballast (as described in greater detail below). Accordingly, if the error value $e_d$ is large, the accumulator will reach the predetermined positive (or negative) value more quickly. Preferably, the predetermined positive and negative values correspond to the size of the accumulator, e.g., $+(2^{16}-1)$ and $-(2^{16}-1)$, respectively, for the 16-bit accumulator ACC. The accumulator reaches the predetermined positive value (or the predetermined negative value) when the accumulator overflows. The microprocessor 450 acts on the overflow of the accumulator by reading a carry flag (which is set when the accumulator overflows) and a negative flag (which is set when the accumulator has a negative value). When the accumulator overflows, the value of the accumulator is automatically reset to zero. The accumulator is also reset to zero at the startup of the microprocessor 450.

Referring to FIG. 6B, if the duty cycle is above (or below) the predetermined target duty cycle $d_{TARGET}$, the microprocessor 450 will slowly decrease (or increase) the operating frequency $f_{OP}$ of the inverter 104, thereby decreasing (or increasing) the required duty cycle $d_{OP}$ to deliver the present target lamp current $I_{TARGET}$. The microprocessor utilizes a correction factor, CF, to generate the operating period $T_{OP}$, and thus the operating frequency $f_{OP}$, of the inverter 104. Preferably, the operating period $T_{OP}$ is equal to the base period $T_{BASE}$ plus the correction factor CF, i.e., $$f_{OP} = \frac{1}{T_{BASE} + CF}. \quad \text{(Equation 1)}$$

The correction factor CF is initialized to zero at the startup of the microprocessor as well as each time the lamp 108 is struck.

When the duty cycle $d_{OP}$ is above the predetermined target duty cycle $d_{TARGET}$, i.e., the accumulator ACC has exceeded the predetermined positive value (at step 514), the microprocessor 450 increases the correction factor CF (at step 516) by a predetermined increment, e.g., preferably 0.125 μsec, which corresponds to a frequency shift of about 252 Hz when the operating frequency $f_{OP}$ is 45 kHz, and a frequency shift of about 607 Hz when the operating frequency $f_{OP}$ is 70kHz. The correction factor CF then is limited to a maximum correction factor $CF_{MAX}$ (at step 518). If the duty cycle $d_{OP}$ is below the predetermined target duty $d_{TARGET}$, i.e., the accumulator ACC has exceeded the predetermined negative value (at step 520), the microprocessor 450 decreases the correction factor CF (at step 522).

Next, the operating frequency of the inverter is limited to a predetermined range of frequencies. The operating period $T_{OP}$, i.e., $T_{BASE}$+CF, is determined at step 524 from the present correction factor CF. If the operating period $T_{OP}$ is less than a predetermined minimum period, $T_{MIN}$, i.e., the operating frequency $f_{OP}$ is greater than a predetermined maximum frequency, $f_{MAX}$ (at step 525), the correction factor CF is set equal to the minimum period $T_{MIN}$ minus the base operating period $T_{BASE}$, i.e., $f_{OP}=1/T_{MIN}$ (at step 526). If the operating period $T_{OP}$, i.e., $T_{BASE}$+CF, is greater than a predetermined maximum period, $T_{MAX}$, i.e., the operating frequency $f_{OP}$ is less than a predetermined minimum frequency, $f_{MIN}$ (at step 528), the correction factor is set equal to the maximum period $T_{MAX}$ minus the base operating period $T_{BASE}$, i.e., $f_{OP}=1/T_{MAX}$ (at step 530). Finally, the operating period $T_{OP}$ is set to the base period $T_{BASE}$ Plus the correction factor CF (at step 532). Accordingly, the microprocessor 450 produces the PWM signal 456 at the operating frequency $f_{OP}$ and operating duty cycle $d_{OP}$.

Figure 6C:
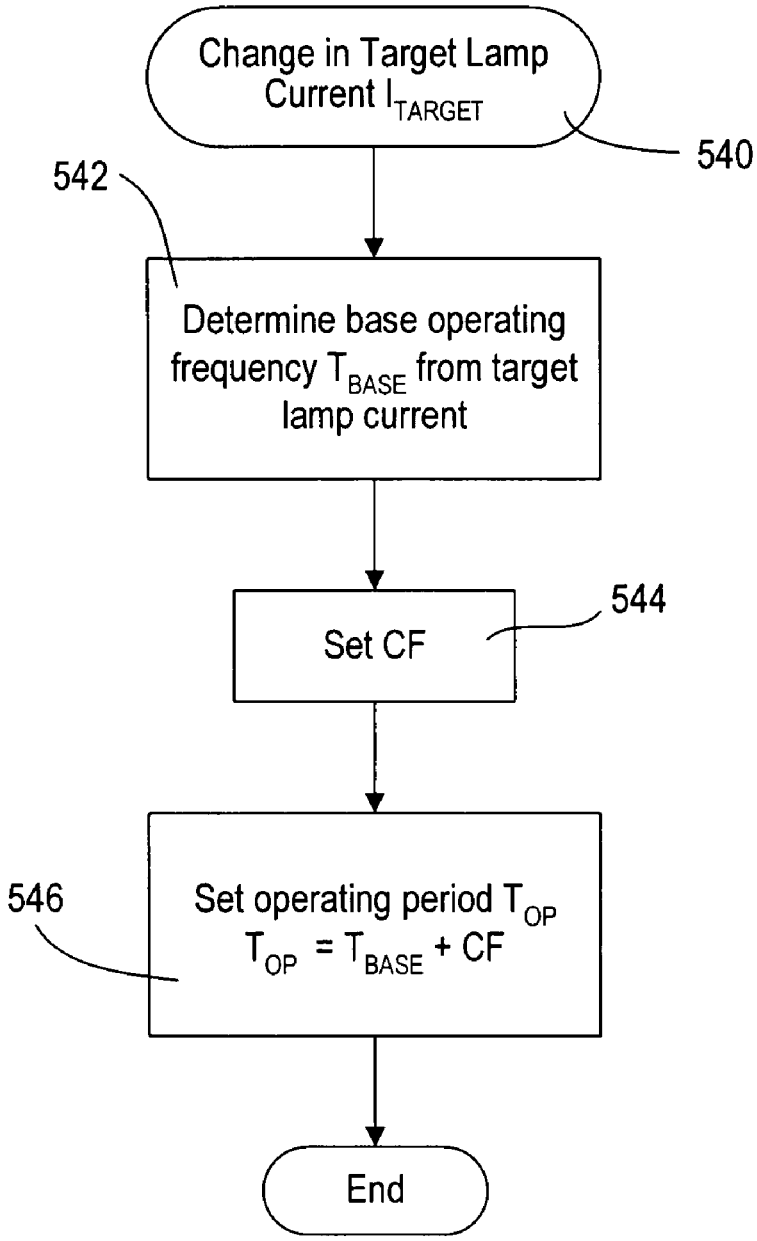
FIG. 6C is a flowchart of the software executed by the microprocessor of the ballast of FIG. 5A in response to a change in a target lamp current.

FIG. 6C is a flowchart of the software executed by the microprocessor 450 when the target lamp current $I_{TARGET}$ changes. In response to a change in the target lamp current $I_{TARGET}$ (at step 540), the microprocessor 450 determines a new base period $T_{BASE}$ (at step 542). The microprocessor 450 may use a predetermined relationship between the target lamp current $I_{TARGET}$ and the base operating frequency $f_{BASE}$, for example, the target ballast operating frequency curve of FIG. 4, to determine the base operating frequency $f_{BASE}$, and thus the base operating period $T_{BASE}$ (since $T_{BASE}=1/f_{BASE}$). Next, the microprocessor 450 sets the correction factor CF at step 544. Preferably, the microprocessor 450 initially maintains the correction factor CF constant (i.e., unchanged) in response to a change in target lamp current $I_{TARGET}$. Finally, the microprocessor 450 sets the new operating period $T_{OP}$ at step 546. Accordingly, the new operating frequency $f_{OP}$ will initially be offset from the new base frequency $f_{BASE}$ by the correction factor CF. Alternatively, at step 544, the microprocessor 450 could set the correction factor CF to a predetermined value, e.g., zero, whenever the target lamp current $I_{TARGET}$ changes. Then, in either case, the microprocessor 450 adaptively modifies the operating frequency $f_{OP}$ from the base frequency $f_{BASE}$ in accordance with the method of the present invention as described above.

Figure 7:
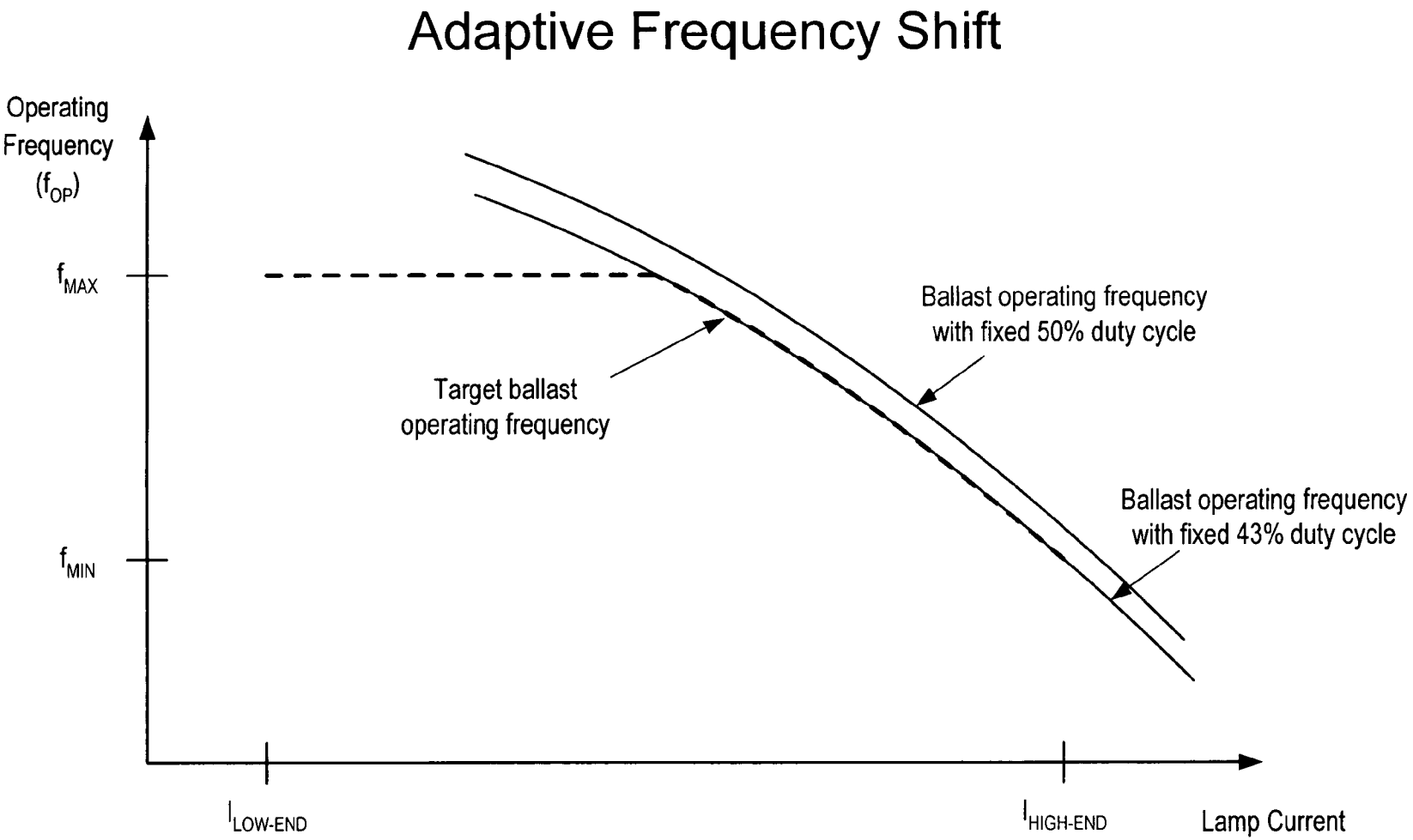
FIG. 7 shows a plot of the operating frequency of the electronic ballast of FIG. 5A according to the present invention.

FIG. 7 shows a plot of the target operating frequency $f_{OP}$ of the ballast 400 versus the lamp current according to the present invention. Further, FIG. 7 shows a plot of the operating frequency versus the lamp current at both a fixed 50% duty cycle and a fixed 43% duty cycle, i.e., the preferred target duty cycle. Accordingly, when operating at a given lamp current (near high-end), the ballast 400 will adaptively shift the operating frequency $f_{OP}$ to achieve a 43% duty cycle. Near low-end, the operating frequency $f_{OP}$ is limited to the predetermined maximum frequency $f_{MAX}$.

The predetermined maximum frequency $f_{MAX}$ is selected to be the desired frequency when operating at low-end. In the present embodiment, at low light levels, the operating duty cycle $d_{OP}$ is less than the predetermined target duty cycle $d_{TARGET}$ (i.e., 43%) and the operating frequency $f_{OP}$ is limited to the predetermined maximum frequency $f_{MAX}$. As the requested light level (i.e., the target lamp current $I_{TARGET}$) is increased, the operating duty cycle $d_{OP}$ is increased while the operating frequency $f_{OP}$ is held constant at the predetermined maximum frequency $f_{MAX}$. The microprocessor 450 eventually reaches a point where the control loop will attempt to drive the operating duty cycle $d_{OP}$ to be over 43%. At this point, the operating frequency $f_{OP}$ shifts while the operating duty cycle $d_{OP}$ remains near the preferred target duty cycle $d_{TARGET}$ of 43%.

Figure 8:
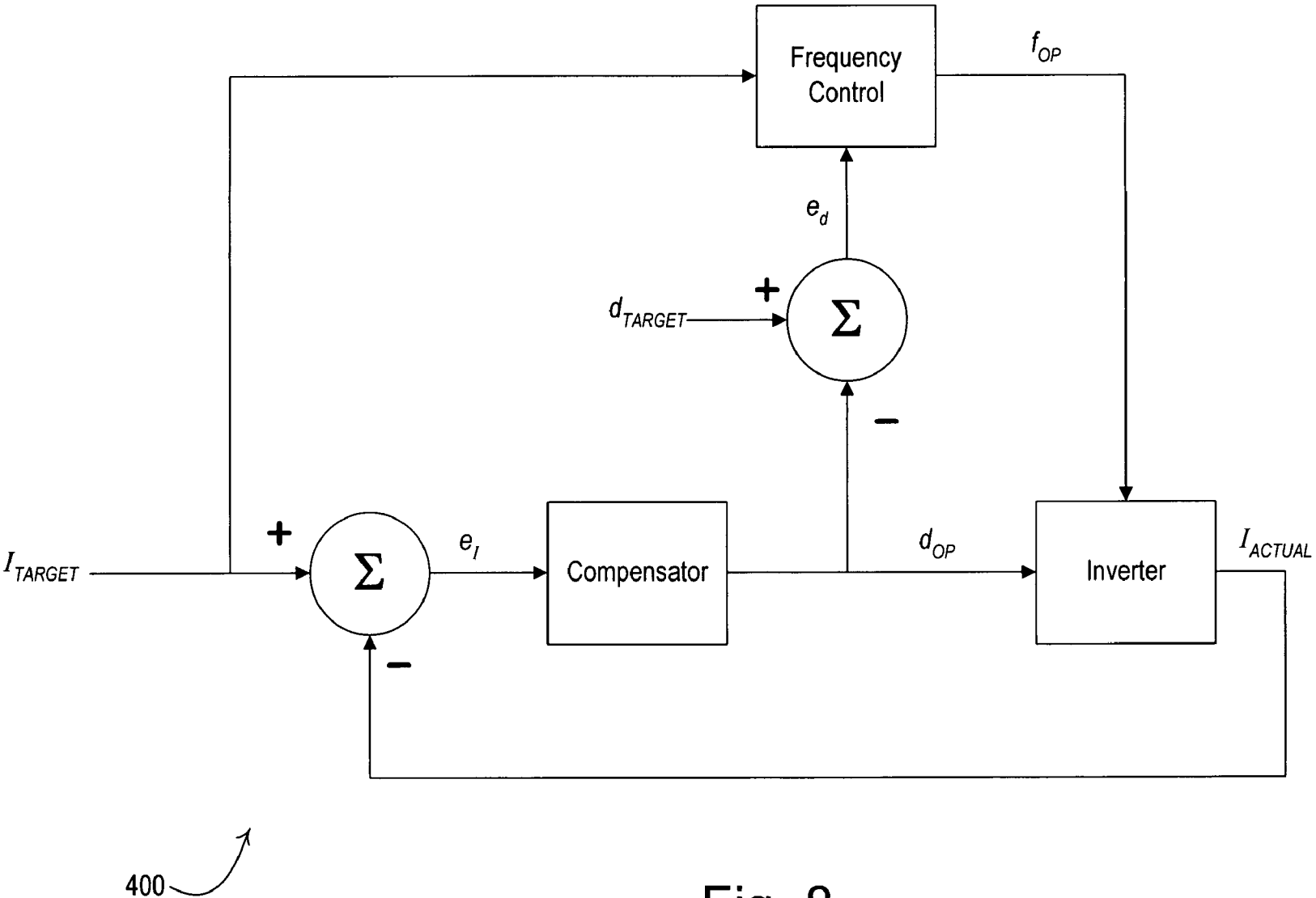
FIG. 8 is a control system diagram illustrating the control loops of the ballast according to a first embodiment of the present invention of FIG. 5A.

FIG. 8 is a control system diagram illustrating the control loops for control of the operating frequency $f_{OP}$ and the operating duty cycle $d_{OP}$ of the ballast 400 according to the present invention. Both the operating frequency $f_{OP}$ and the operating duty cycle $d_{OP}$ are controlled via closed-loop techniques. As in the prior art ballasts 100, 300, the actual lamp current $I_{ACTUAL}$ is provided as feedback to the duty-cycle control loop and is subtracted from the target current $I_{TARGET}$ to produce a lamp current error signal, $e_l$, and thus, via the compensator, the desired duty cycle signal $d_{OP}$. However, in the ballast 400 of the present invention, the desired frequency signal $f_{OP}$ is determined in response to the target lamp current, the operating duty cycle, and the target duty cycle.

The correction value CF, i.e., the operating frequency $f_{OP}$, is adjusted very slowly with respect to the operating duty cycle $d_{OP}$. This slow adjustment prevents unstable operation that could result if both control loops had similar response times (or similar bandwidths). Preferably, the operating duty cycle $d_{OP}$ adjustment operates with a response time of 1 msec to 2 msec, i.e., with a bandwidth of 500 Hz to 1 kHz, while the operating frequency $f_{OP}$ adjustment operates with a response time of 0.7 sec to 1.4 sec, i.e., with a bandwidth of 0.7 Hz to 1.4 Hz. Specifically, the response time of the operating frequency $f_{OP}$ control loop of the ballast 400 is determined by the cycle time of the frequency adjustment process (of FIGS. 6A and 6B), the size of the accumulator ACC, and the values of the maximum duty-cycle error values $e_{MAX+}$, $e_{MAX-}$. Preferably, the operating duty cycle $d_{OP}$ is adjusted at least ten times faster than the operating frequency $f_{OP}$.

Figure 4:
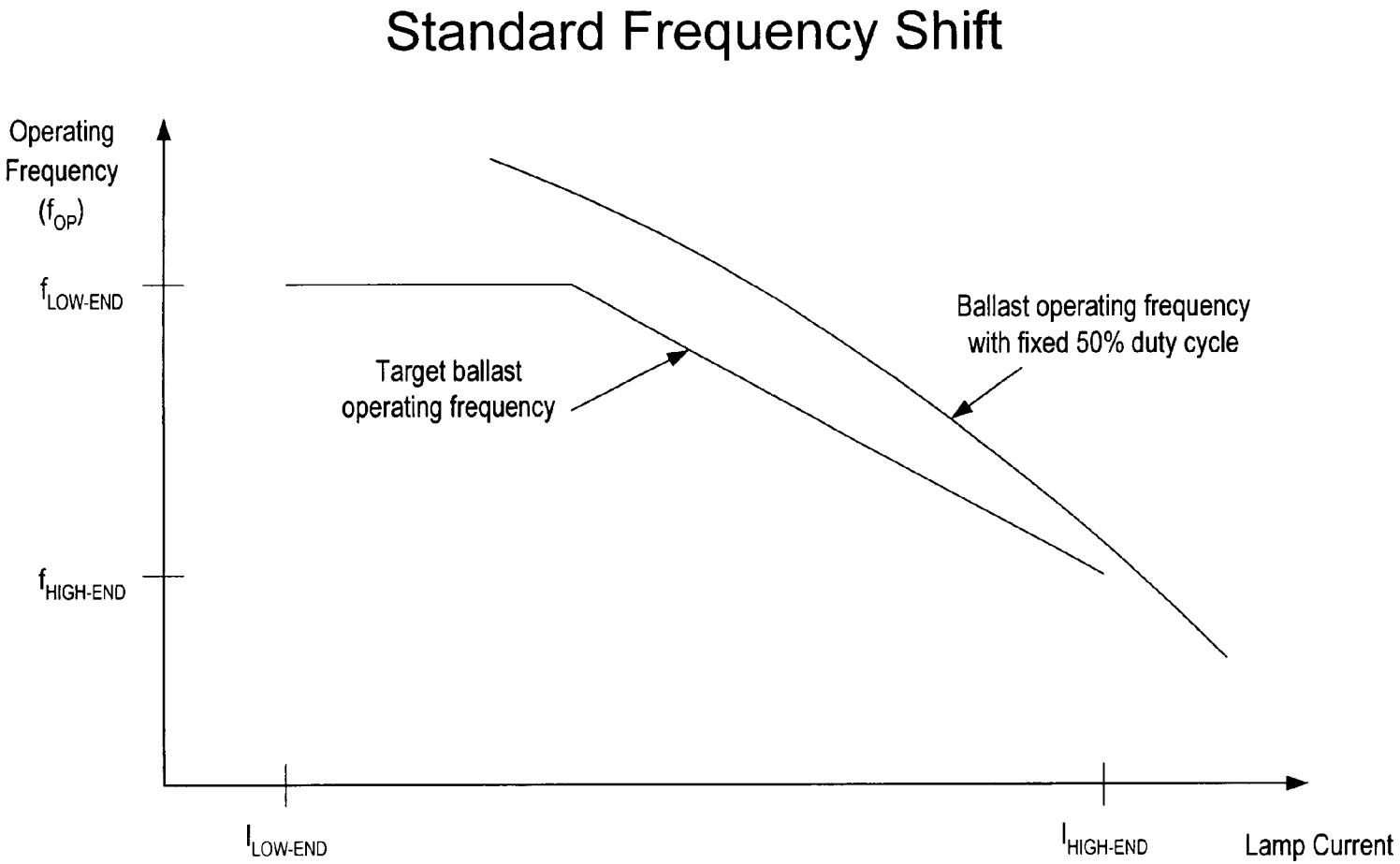
Fig. 4 Prior Art
FIG. 4 is a plot of the operating frequency of an inverter of the electronic ballast of FIGS. 1 and 2 versus the lamp current.

In the event of rapid changes in desired light level, the predetermined relationship between the target lamp current $I_{TARGET}$ and the base operating frequency $f_{BASE}$, i.e., the target ballast operating frequency curve of FIG. 4, gets the operating frequency $f_{OP}$ in the ballpark. Then, the adaptive frequency shift routine makes small corrections to the operating frequency $f_{OP}$ very slowly without any noticeable lag in performance. While it is important for the modification of the operating frequency $f_{OP}$ to be slow with respect to the adjustment of the duty cycle $d_{OP}$ to avoid oscillations, the duty cycle control loop must be fast enough to reach the desired light level quickly enough so as to not cause a noticeable lag in dimming performance.

Testing has shown that a duty cycle of 43% is sufficient, i.e., high enough, to prevent "mercury pumping" in the lamp 108. The duty cycle of 43% is also low enough to allow for dynamic "headroom" (or margin) with respect to the duty cycle of 50%, which is the maximum duty cycle of the ballast 400. Since the correction factor is initially held constant when the target light level changes (in the preferred embodiment of the present invention), and the operating frequency is adjusted rather slowly, the operating duty cycle will most likely temporarily rise above 43% when the desired light level, i.e., the desired lamp current, is quickly increased. The headroom minimizes the likelihood that the duty cycle will reach 50% and the compensator circuit 216 will saturate.

Figure 9:
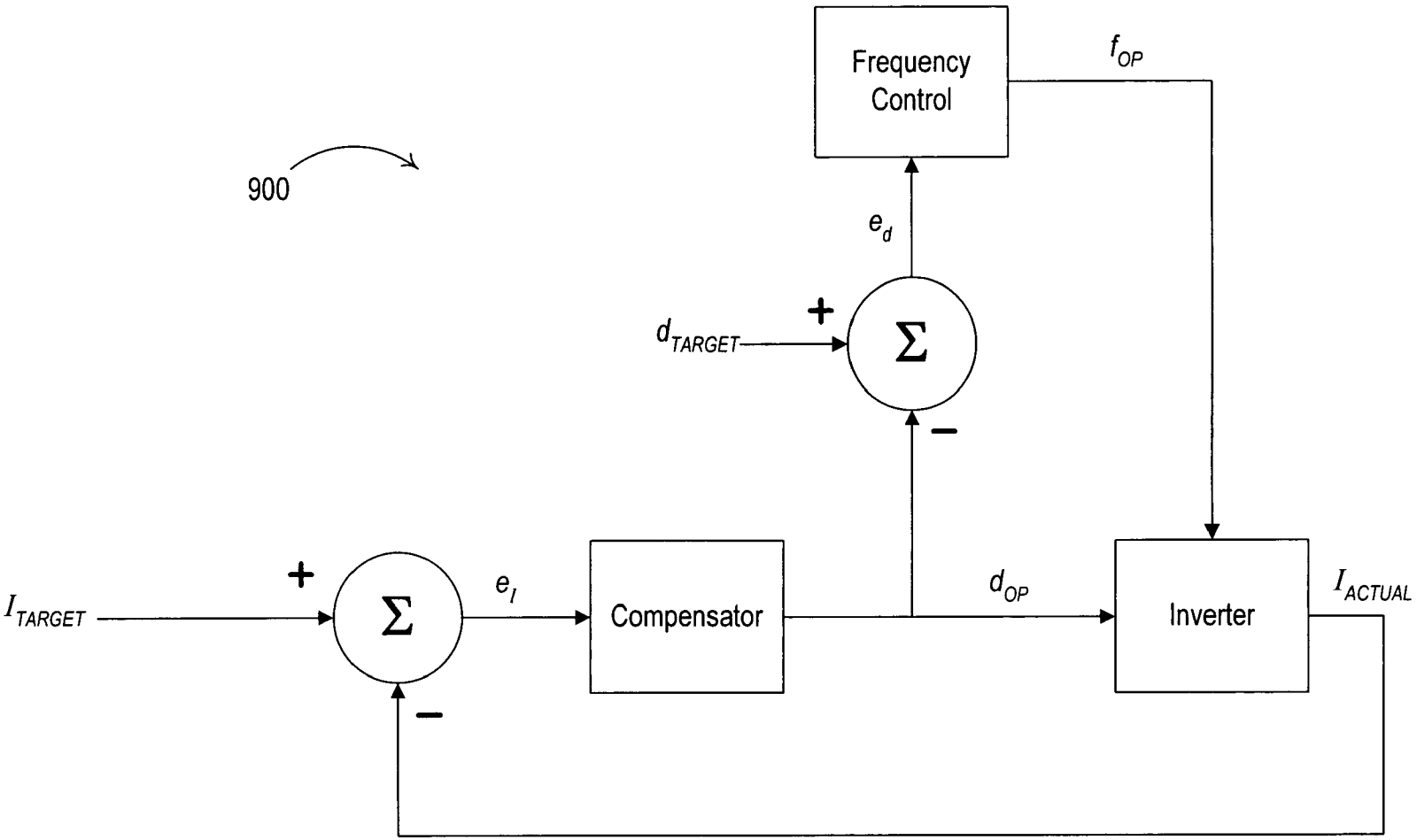
FIG. 9 is a control system diagram illustrating the control loops of a second embodiment of the ballast of the present invention.

FIG. 9 is a control system diagram illustrating the control loops of a ballast 900 according to a second embodiment of the present invention. The ballast 900 is operable to control the operating frequency of the ballast in response to only the operating duty cycle and the target duty cycle. In this embodiment, the ballast 900 is not operable to control the operating frequency in dependence upon the target lamp current. The ballast 900 is operable to drive the lamp 108 such that mercury pumping is avoided. However, when the target lamp current changes, the actual lamp current, and thus the lamp intensity, changes at a slower rate than in the previous embodiment, since the operating frequency control loop, i.e., the duty cycle error value $e_d$, is solely in control of the operating frequency.

Figure 10:
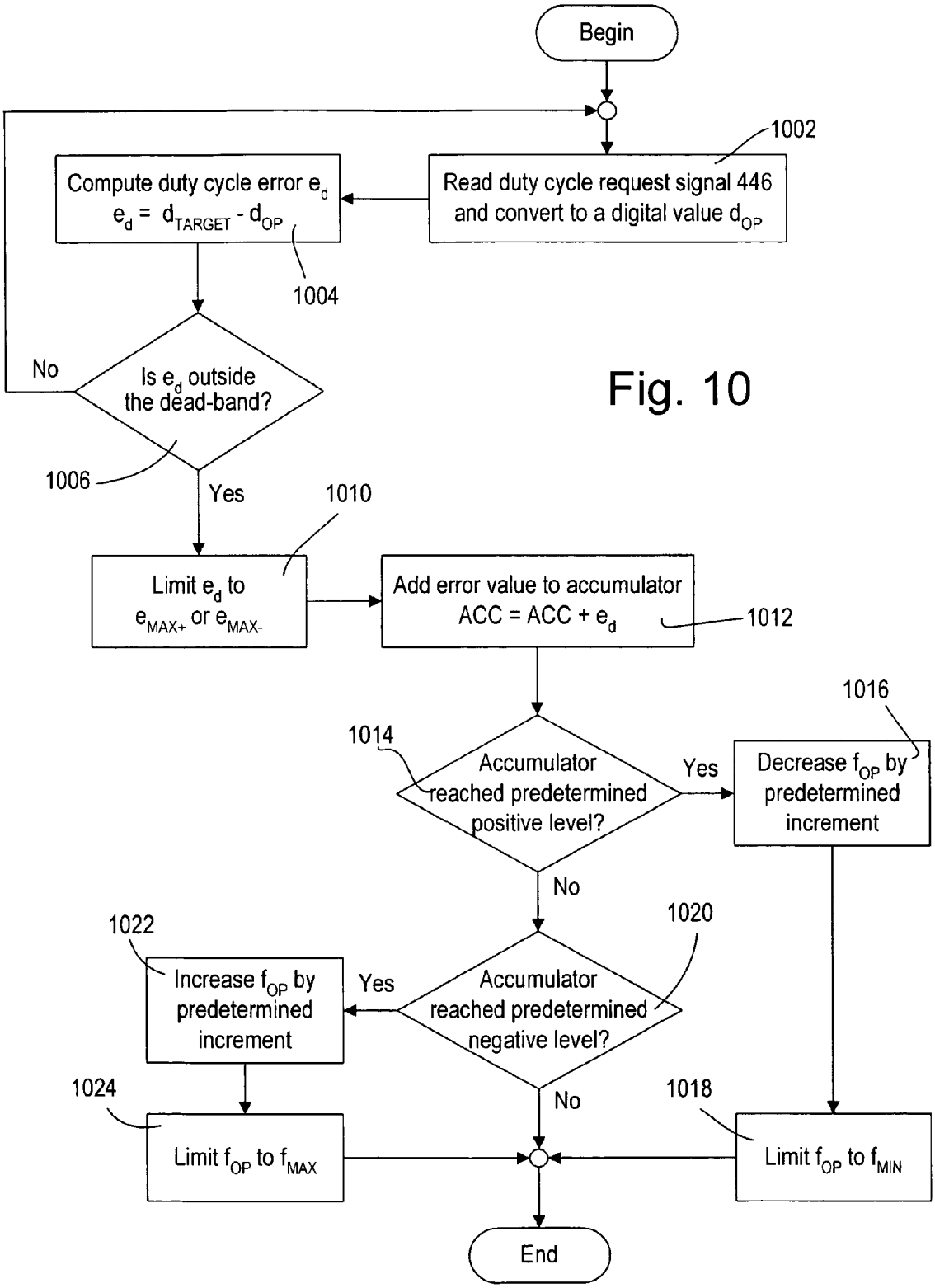
FIG. 10 is a flowchart of the software executed by a microprocessor of the ballast of FIG. 9 according to a second embodiment of the present invention.

FIG. 10 is a flowchart of the software executed by the microprocessor of the ballast 900 to adaptively change the operating frequency $f_{OP}$ according to the second embodiment of the present invention. Steps 1002 through 1012 are similar in function to steps 502 through 512 (of FIGS. 6A and 6B) executed by the microprocessor 450 of the ballast 400 according to the first embodiment of the present invention. The process of FIG. 10 does not utilize either a base period or a correction factor to determine the operating period $T_{OP}$ and the operating frequency $f_{OP}$.

If the accumulator has reached a predetermined positive level at step 1014, then the operating frequency $f_{OP}$ is decreased by a predetermined increment, e.g., preferably 314 Hz, at step 1016 and limited to a minimum operating frequency $f_{MIN}$, e.g., preferably about 45 kHz, at step 1018. Alternatively, if the accumulator has reached a predetermined negative level at step 1020, then the operating frequency $f_{OP}$ is increased by the predetermined increment, i.e., 314 Hz, at step 1022 and limited to a maximum operating frequency $f_{MAX}$, e.g., preferably about 70 kHz, at step 1024. If the accumulator has reached neither the predetermined positive level nor the predetermined negative level, the process exits without changing the operating frequency $f_{OP}$.

Figure 11:
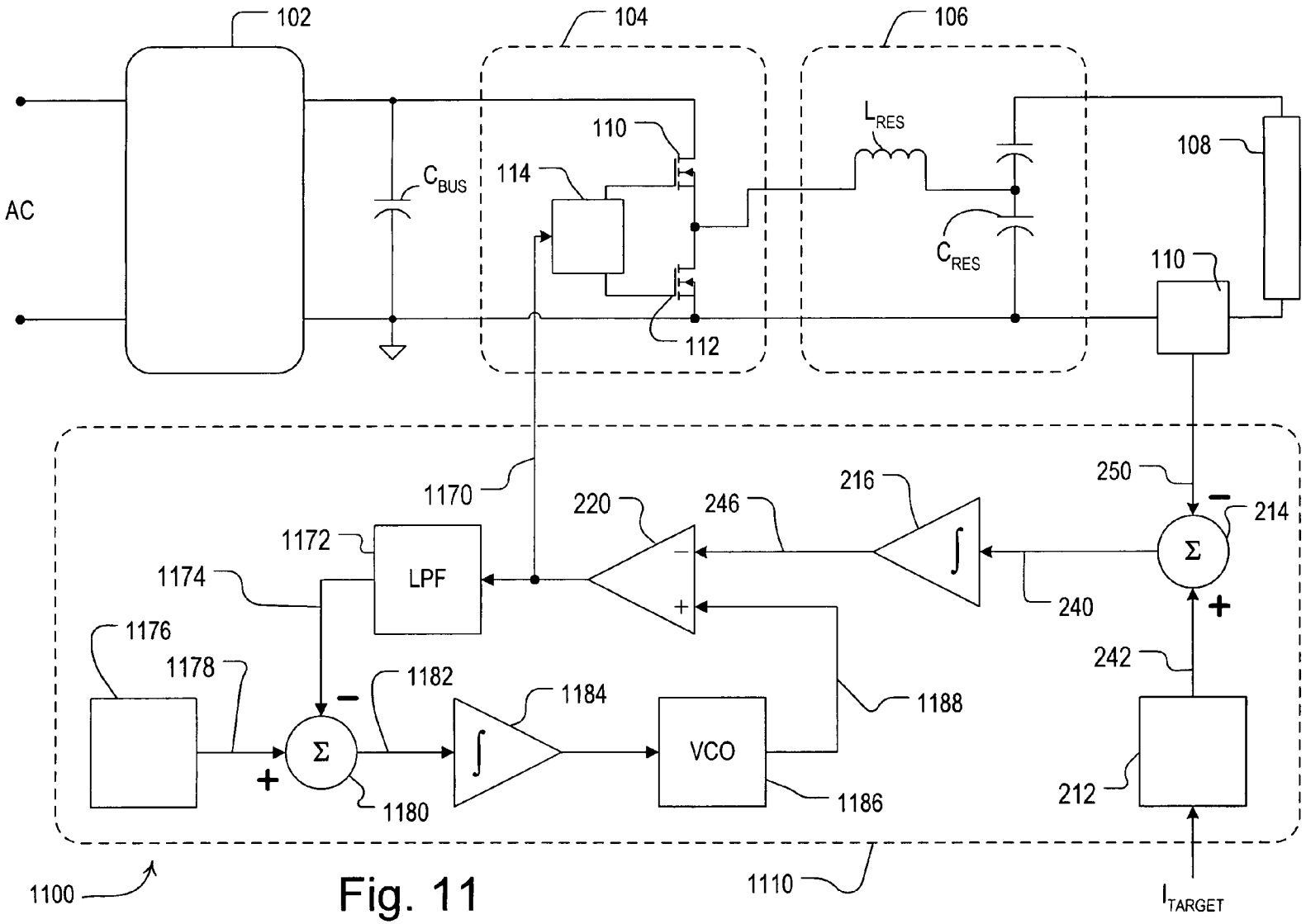
FIG. 11 is a simplified schematic diagram of a ballast according to a third embodiment of the present invention.

FIG. 11 is a simplified schematic diagram of a ballast 1100 according to a third embodiment of the present invention. The ballast 1100 has an entirely analog control circuit 1110, with a control loop for control of the operating duty cycle $d_{OP}$ and another control loop for control of the operating frequency $f_{OP}$. The components of the duty cycle control loop, i.e., the reference circuit 212, the summing circuit 214, and the compensator circuit 216, operate the same way as those components of the analog control circuit 210 of the prior art ballast 100 to produce a PWM signal 1170 characterized by the operating duty cycle $d_{OP}$ and the operating frequency $f_{OP}$ at the output of the comparator 220.

However, the analog control circuit 1110 uses the operating duty cycle $d_{OP}$ as feedback to determine the operating frequency $f_{OP}$. The PWM signal 1170 is provided to a low pass filter (LPF) 1172 to produce a first DC reference signal 1174 representative of the duty cycle of the PWM signal 1170. A reference circuit 1176 generates a second DC reference signal 1178, which is representative of the target duty cycle $d_{TARGET}$. The first DC reference signal 1174 is subtracted from the second DC reference signal 1178 by an adding circuit 1180 to produce a duty cycle error signal 1182. The duty cycle error signal 1182 is provided to a compensator circuit 1184, which includes an integrator (not shown) and drives a voltage-controlled oscillator (VCO) 1186, e.g., a triangle wave oscillator. The VCO 1186 produces a triangle wave 1188 at a frequency dependent on the voltage provided by the compensator circuit 1184. The triangle wave 1188 is compared to the duty cycle request voltage 246 by the comparator 220 to produce the PWM signal 1170.

The frequency control loop of the analog control circuit 1110 operates to drive the duty cycle error signal 1182 to zero. Changes in the operating frequency $f_{OP}$ will result in changes in the current through the lamp 108. Accordingly, the duty cycle control loop of the analog control circuit 1110 will change the operating duty cycle $d_{OP}$ to achieve the target lamp current $I_{TARGET}$. Since the ballast 1100 controls the operating frequency $f_{OP}$ only in response to the operating duty cycle $d_{OP}$ and the target duty cycle $d_{TARGET}$, the ballast 1100 operates according to the control system diagram of FIG. 9.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An electronic ballast for driving a gas discharge lamp, the ballast comprising:

an inverter operable to convert a substantially DC bus voltage to a high-frequency AC voltage having an operating frequency and an operating duty cycle;

a resonant tank operable to couple the high-frequency AC voltage to the lamp to generate a present lamp current through the lamp;

a control circuit operable to control the operating frequency and the operating duty cycle of the high-frequency AC voltage of the inverter and operable to receive a target lamp current signal representative of a target lamp current; and a current sense circuit operable to provide to the control circuit a present lamp current signal representative of the present lamp current;

wherein the control circuit is operable to control the operating duty cycle of the high-frequency AC voltage of the inverter in response to the target lamp current signal and the present lamp current signal; and the control circuit is operable to control the operating frequency of the high-frequency AC voltage of the inverter in response to the operating duty cycle and a target duty cycle, such that the control circuit is operable to minimize the difference between the operating duty cycle and the target duty cycle.

2. The electronic ballast of claim 1, wherein the control circuit comprises a digital portion and an analog portion.

3. The electronic ballast of claim 2, wherein the digital portion comprises a microprocessor for control of the inverter.

4. The electronic ballast of claim 3, wherein the microprocessor is operable to receive the target lamp current signal.

5. The electronic ballast of claim 4, wherein the microprocessor is operable to control the operating frequency of the inverter to a base operating frequency in response to the target lamp current signal, when the target lamp current changes in value.

6. The electronic ballast of claim 4, wherein the microprocessor is operable to control the operating frequency of the inverter to a base operating frequency in response to the target lamp current signal in dependence upon a predetermined relationship between the operating frequency and the target lamp current.

7. The electronic ballast of claim 4, wherein the microprocessor is operable to receive the target lamp current signal from a phase-control input.

8. The electronic ballast of claim 4, wherein the microprocessor is operable to receive the target lamp current signal from a digital message received from a communication link.

9. The electronic ballast of claim 3, wherein the analog portion comprises:

a summing circuit operable to generate an error signal representative of the difference between the present lamp current signal and a target lamp current signal representative of the target lamp current; and a compensator circuit operable to generate a control signal representative of the operating duty cycle in response to the error signal.

10. The electronic ballast of claim 9, wherein the microprocessor is operable to provide the target lamp current signal representative of the target lamp current.

11. The electronic ballast of claim 9, wherein the microprocessor comprises an analog-to-digital converter for receipt of the control signal generated by the compensator circuit.

12. The electronic ballast of claim 3, wherein the microprocessor is operable to drive the inverter with a pulse-width modulated signal at the operating frequency and the operating duty cycle.

13. The electronic ballast of claim 1, wherein the control circuit comprises an analog control circuit having an operating frequency control portion and an operating duty cycle control portion.

14. The electronic ballast of claim 13, wherein the operating frequency control portion comprises:

a first summing circuit operable to generate a first error signal representative of the difference between the operating duty cycle and the target duty cycle;

a first compensator circuit operable to generate a first control signal representative of the operating frequency in response to the first error signal; and a voltage-controlled oscillator operable to generate an oscillating signal having a frequency dependent on the first control signal.

15. The electronic ballast of claim 14, wherein the operating duty cycle control portion comprises:

a second summing circuit operable to generate a second error signal representative of the difference between the present lamp current signal and the target lamp current signal; and a second compensator circuit operable to generate a second control signal representative of the operating duty cycle in response to the second error signal.

16. The electronic ballast of claim 15, wherein the analog control circuit further comprises:

a comparator operable to compare the first control signal and the second control signal and to generate a pulse-width modulated signal at the operating frequency and the operating duty cycle.

17. The electronic ballast of claim 1, wherein the control circuit is operable to control the operating duty cycle with a first response time and to control the operating frequency with a second response time substantially greater than the first response time.

18. The electronic ballast of claim 1, wherein the control circuit is operable to control the operating frequency of the high-frequency AC voltage of the inverter further in response to the target lamp current signal.

19. The electronic ballast of claim 1, wherein the target duty cycle is about 43%.

20. A method for controlling an electronic ballast for driving a gas discharge lamp, the ballast comprising an inverter characterized by an operating frequency and an operating duty cycle, the method comprising the steps of:

generating a lamp current through the gas discharge lamp in response to the operating frequency and the operating duty cycle of the inverter;

generating a present lamp current signal representative of the lamp current through the gas discharge lamp;

receiving a target lamp current signal representative of a target lamp current;

controlling the duty cycle of the inverter in response to the target lamp current signal and the present lamp current signal; and controlling the operating frequency of the inverter in response to the operating duty cycle of the inverter and a target duty cycle, such that the difference between the operating duty cycle and the target duty cycle is minimized.

21. The method of claim 20, further comprising the step of:

generating a duty cycle error value representative of the difference of the target duty cycle and the operating duty cycle;

wherein the step of controlling the operating frequency comprises controlling the operating frequency in response to the duty cycle error value, such that the duty cycle error value is minimized.

22. The method of claim 21, further comprising the step of:

setting the operating frequency of the inverter to a base operating frequency, when the target lamp current changes in value, in dependence upon a predetermined relationship between the operating frequency and the target lamp current.

23. The method of claim 22, wherein the operating frequency is determined from the base operating frequency and a correction factor.

24. The method of claim 23, wherein the correction factor is increased when the duty cycle error value is positive and is decreased when the duty cycle error value is negative.

25. The method of claim 24, wherein the operating frequency is limited to a predetermined range of frequencies.

26. The method of claim 23, wherein the correction factor is changed to a predetermined value when the target lamp current changes in value.

27. The method of claim 26, wherein the predetermined value is zero.

28. The method of claim 23, wherein the correction factor is initially held constant when the target lamp current changes in value.

29. The method of claim 21, wherein the operating frequency is decreased when the duty cycle error value is positive and is increased when the duty cycle error value is negative.

30. The method of claim 29, wherein the operating frequency is limited to a predetermined range of frequencies.

31. The method of claim 21, wherein the step of controlling the operating frequency comprises minimizing the duty cycle error value only so long as the duty cycle error value is outside of a dead-band.

32. The method of claim 20, further comprising the step of:

setting the operating frequency of the inverter to a base operating frequency in dependence on the target lamp current signal, when the target lamp current changes in value.

33. The method of claim 20, further comprising the step of:

generating a current error signal representative of the difference of the target lamp current signal and the present lamp current signal;

wherein the step of controlling the duty cycle comprises controlling the duty cycle in response to the current error signal, such that the current error signal is minimized.

34. The method of claim 20, wherein the step of adjusting the duty cycle is performed with a first response time and the step of adjusting the operating frequency is performed with a second response time substantially greater than the first response time.

35. The method of claim 20, wherein the target duty cycle is about 43%.

36. A control circuit for an electronic ballast having an inverter for driving a gas discharge lamp, the control circuit operable to control an operating frequency and an operating duty cycle of the inverter of the ballast, the control circuit comprising:

a duty cycle control portion for controlling the operating duty cycle of the inverter in response to a target lamp current signal and a present lamp current signal; and a frequency control portion for controlling the operating frequency of the inverter in response to the operating duty cycle and a target duty cycle;

wherein the frequency control portion is operable to minimize the difference between the operating duty cycle and the target duty cycle.

37. The control circuit of claim 36, wherein the frequency control portion is further operable to control the operating frequency in response to the target lamp current signal.

38. The control circuit of claim 37, wherein the frequency control portion is responsive to a duty cycle error signal representative of the difference between the operating duty cycle and the target duty cycle.

39. The control circuit of claim 38, wherein the duty cycle control portion is responsive to a lamp current error signal representative of the difference between the present lamp current signal and the target lamp current signal.

40. The control circuit of claim 36, wherein the duty cycle control portion operates with a first response time and the frequency control portion operates with a second response time substantially greater that the first response time.

41. An electronic ballast for driving a gas discharge lamp, the ballast comprising:

an inverter operable to convert a substantially DC bus voltage to a high-frequency AC voltage having an operating frequency and an operating duty cycle;

a resonant tank operable to couple the high-frequency AC voltage to the lamp to generate a present lamp current through the lamp;

a control circuit operable to control the operating frequency and the operating duty cycle of the high-frequency AC voltage of the inverter and operable to receive a target lamp current signal representative of a target lamp current; and a current sense circuit operable to provide to the control circuit a signal representative of the present lamp current;

wherein the control circuit is operable to control the operating frequency to a base operating frequency in dependence on the target lamp current signal, when the target lamp current changes in value;

to control the operating duty cycle in response to a target lamp current signal and the present lamp current signal; and to control the operating frequency in response the operating duty cycle and a target duty cycle, such that the control circuit is operable to minimize the difference between the operating duty cycle and the target duty cycle.

* * * * *